US010639722B2

(12) United States Patent
Liu et al.

(10) Patent No.: US 10,639,722 B2
(45) Date of Patent: May 5, 2020

(54) PREPARATION METHOD AND PREPARATION DEVICE FOR SILVER-METAL OXIDE ELECTRICAL CONTACT MATERIAL AND APPLICATION OF THE MATERIAL

(71) Applicants: Nan Liu, Shanghai (CN); SCHNEIDER ELECTRIC INDUSTRIES SAS, Rueil-Malmaison (FR)

(72) Inventors: Nan Liu, Shanghai (CN); Yijian Lai, Shanghai (CN); Binyuan Zhao, Shanghai (CN)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 275 days.

(21) Appl. No.: 15/534,194

(22) PCT Filed: Dec. 11, 2015

(86) PCT No.: PCT/CN2015/097184
§ 371 (c)(1),
(2) Date: Jun. 8, 2017

(87) PCT Pub. No.: WO2016/091216
PCT Pub. Date: Jun. 16, 2016

(65) Prior Publication Data

US 2017/0333996 A1 Nov. 23, 2017

(30) Foreign Application Priority Data

Dec. 12, 2014 (CN) ..... 2014 1 0768634

(51) Int. Cl.

| | |
|---|---|
| ***B22F 9/24*** | (2006.01) |
| ***B22F 1/02*** | (2006.01) |
| ***H01H 1/0237*** | (2006.01) |
| ***B22F 1/00*** | (2006.01) |

(52) U.S. Cl.
CPC ..... *B22F 9/24* (2013.01); *B22F 1/0018* (2013.01); *B22F 1/0085* (2013.01); *B22F 1/02* (2013.01); *H01H 1/0237* (2013.01); *B22F 2201/10* (2013.01); *B22F 2301/255* (2013.01); *H01H 1/02372* (2013.01); *H01H 2300/036* (2013.01)

(58) Field of Classification Search
CPC ..... B22F 1/0018; B22F 1/0085; B22F 1/02; B22F 2201/10; B22F 2301/255; B22F 9/24; H01H 1/0237; H01H 1/02372; H01H 2300/036
See application file for complete search history.

(56) References Cited

U.S. PATENT DOCUMENTS

| | | | | |
|---|---|---|---|---|
| 4,023,961 | A * | 5/1977 | Douglas | B22F 9/026 75/355 |
| 6,409,794 | B2 | 6/2002 | Wolmer et al. | |
| 2007/0051927 | A1 * | 3/2007 | Itoh | B22F 1/0003 252/500 |
| 2010/0025639 | A1 * | 2/2010 | Ogi | B22F 1/0062 252/514 |
| 2013/0266791 | A1 | 10/2013 | Chen et al. | |

FOREIGN PATENT DOCUMENTS

| | | | |
|---|---|---|---|
| CN | 101071687 | A * | 11/2007 |
| CN | 100552844 | C | 10/2009 |
| CN | 102389981 | A | 3/2012 |
| CN | 102142325 | B | 4/2013 |
| CN | 204842969 | U | 12/2015 |
| DE | 10017282 | A1 | 10/2001 |

OTHER PUBLICATIONS

Chinese International Search Report and Written Opinion from corresponding PCT/CN2015/097184 dated Mar. 16, 2016.

* cited by examiner

*Primary Examiner* — Jenny R Wu
(74) *Attorney, Agent, or Firm* — Lando & Anastasi, LLP

(57) ABSTRACT

A preparation method for a silver-metal oxide electrical contact material, comprising: (1) mixing a silver-containing precursor solution with a metal oxide precursor solution; (2) reacting a reducing agent with the mixed solution to obtain silver powder coated with a metal oxide precursor; (3) heat treating the silver powder in a non-reducing atmosphere to obtain the silver-metal oxide electrical contact material. A preparation device for a silver-metal oxide electrical contact material, a silver-metal oxide electrical contact material prepared by the preparation method, and an electrical contact prepared by the silver-metal oxide electrical contact material. The electrical contact material prepared by the preparation method is at nanoscale, significantly prolonging electrical endurance of the electrical contact.

10 Claims, 4 Drawing Sheets

PREPARATION METHOD AND PREPARATION DEVICE FOR SILVER-METAL OXIDE ELECTRICAL CONTACT MATERIAL AND APPLICATION OF THE MATERIAL

CROSS-REFERENCE TO RELATED APPLICATIONS

This application is a U.S. National Stage Application under 35 U.S.C. § 371 of International Application No. PCT/CN2015/097184 filed Dec. 11, 2015, which claims priority to Chinese Application Number 201410768634.1, filed Dec. 12, 2014, the disclosures of each of these applications are incorporated herein by reference in their entirety.

FIELD OF INVENTION

Embodiments of the present invention relate to the field of electrical contacts and, in particular, to a preparation method and a preparation device for a silver-metal oxide electrical contact material and an application of the material.

BACKGROUND

An electrical contact is a key element of an electrical switch, an instrument and the like, and undertakes tasks of turning on, carrying and breaking a normal current and a fault current. Among electrical contact materials for producing the electrical contact, silver-based electrical contact materials are the most important, the most widely used and the cheapest electrical contact materials. In particular, silver-based metal oxides are widely applicable in low-voltage electrical contact materials due to their good resistance to electrical wear, resistance to fusion welding and electrical conductivity. Silver-based metal oxide electrical contact materials generally contain two components, one component being a pure metal Ag that can provide high conductivity, good resistance to oxidation and nitridation, and the other component being a metal oxide, such as $SnO_2$, ZnO and the like, mainly determining the arc breaking performance. The addition of the metal oxide can significantly improve the electrical contact performance of the electrical contact materials. Electrical contact materials having been developed mainly include Ag—ZnO, Ag—CuO, Ag—NiO, Ag—$SnO_2$ and the like. At present, an alloy internal oxidation method and a powder metallurgy method are preparation processes which are widely used in industrial applications for an Ag—MeO electrical contact material. As for the powder metallurgy process, in a preparation stage of a raw material powder, mechanical mixing is mainly used, such as a mechanical alloying method. The use of this powder mixing process requires simple equipment, and it is easy to control the addition of elements, and the composition of the alloy can be adjusted in a wide range, and a uniformly organized, larger contact can be prepared. However, if the powder mixing time (powder mixing condition) is not well controlled, powder surface condition or particle distribution is prone to vary, resulting in component segregation, work hardening, etc. The eventually prepared material has a lower density, and oxide particles are coarse, resulting in poor resistance to arc corrosion which affects the electrical endurance of the contact. The internal oxidation method is characterized by a high alloy density, a smaller electrical wear of the contact, a long life, and ease of mass production. However, drawbacks are obvious that the size of the product should not be too thick, and the organization is prone to exhibit "poor oxygen zones" which lead to non-uniformity, so that the product performance deteriorates.

SUMMARY

In view of the drawbacks of the prior art described above, embodiments of the present invention provide a preparation method and a preparation device for a silver-metal oxide electrical contact material so as to obtain an electrical contact material with a significant increase in strength and hardness, and a significant improvement in processing performance, electrical conductivity, resistance to electrical corrosion and resistance to fusion welding, especially an electrical endurance extension.

According to a first aspect of the present invention, there is provided a preparation method for a silver-metal oxide electrical contact material, comprising:

(1) mixing a silver-containing precursor solution with a metal oxide precursor solution;

(2) reacting a reducing agent with the mixed solution to obtain silver powder coated with a metal oxide precursor; and (3) heat treating the silver powder in a non-reducing atmosphere to obtain the silver-metal oxide electrical contact material.

In one embodiment of the present invention, the step (2) includes: reacting the reducing agent with the mixed solution, filtering a suspension obtained by the reacting, and drying a precipitate obtained by the filtering, to obtain the silver powder coated with the metal oxide precursor.

In another embodiment of the present invention, the silver-containing precursor solution is a silver ammonia solution with a silver concentration of 10 to 1000 ppm.

In another embodiment of the present invention, the metal oxide precursor solution is a metal acetate or nitrate solution, wherein the metal is one or more of Zn, Cu, In, Ni, W, and Mo.

In yet another embodiment of the present invention, the metal oxide is one or more of ZnO, CuO, $In_2O_3$, $Ni_2O$, $WO_3$, and $MoO_3$.

In yet another embodiment of the present invention, the reducing agent is one or more of hydrazine hydrate, ascorbic acid and sodium borohydride.

In yet another embodiment of the present invention, the non-reducing atmosphere is an inert atmosphere or an oxidizing atmosphere.

In yet another embodiment of the present invention, the inert atmosphere is nitrogen and/or rare gas, wherein the rare gas is one or more of argon, helium, and neon.

In yet another embodiment of the present invention, the heat treating is calcining at 150 to 800° C. for 1 to 12 hours.

In yet another embodiment of the present invention, a mass percentage of the silver in the silver-metal oxide electrical contact material is 65 to 99%.

In yet another embodiment of the present invention, silver particles and/or metal oxide particles in the silver-metal oxide electrical contact material are at nanoscale.

According to a second aspect of the present invention, there is provided a preparation device for a silver-metal oxide electrical contact material, comprising:

a mixing-reacting device for mixing a silver-containing precursor solution with a metal oxide precursor solution, and reacting a reducing agent with the mixed solution to obtain silver powder coated with a metal oxide precursor; and a heat treating device for heat treating the silver powder in a non-reducing atmosphere to obtain the silver-metal oxide electrical contact material.

In one embodiment of the present invention, the preparation device further includes: a filtering device for filtering a suspension obtained by the reacting in the mixing-reacting device; and a drying device for drying a precipitate obtained by the filtering in the filtering device.

In another embodiment of the present invention, the silver-containing precursor solution is a silver ammonia solution with a silver concentration of 10 to 1000 ppm.

In another embodiment of the present invention, the metal oxide precursor solution is a metal acetate or nitrate solution, wherein the metal is one or more of Zn, Cu, In, Ni, W, and Mo.

In yet another embodiment of the present invention, the metal oxide is one or more of ZnO, CuO, $In_2O_3$, $Ni_2O$, $WO_3$, and $MoO_3$.

In yet another embodiment of the present invention, the reducing agent is one of hydrazine hydrate, ascorbic acid and sodium borohydride.

In yet another embodiment of the present invention, the non-reducing atmosphere is an inert atmosphere or an oxidizing atmosphere.

In yet another embodiment of the present invention, the inert atmosphere is nitrogen and/or rare gas, wherein the rare gas is one or more of argon, helium, and neon.

In yet another embodiment of the present invention, the heat treating is calcining at 150 to 800° C. for 1 to 12 hours.

In yet another embodiment of the present invention, a mass percentage of the silver in the silver-metal oxide electrical contact material is 65 to 99%.

In yet another embodiment of the present invention, silver particles and/or metal oxide particles in the silver-metal oxide electrical contact material are at nanoscale.

According to a third aspect of the present invention, there is provided a silver-metal oxide electrical contact material prepared by the preparation method for the silver-metal oxide electrical contact material according to the first aspect of the present invention, wherein the silver-metal oxide electrical contact material is at nanoscale.

According to another aspect of the present invention, there is provided an electrical contact prepared by the silver-metal oxide electrical contact material according to the third aspect of the present invention, wherein the silver-metal oxide electrical contact material is at nanoscale.

The preparation method for the silver-metal oxide electrical contact material according to an embodiment of the present invention performs a powder mixing reaction by in-situ synthesis liquid phase reduction method, and then converts the precursor into oxide powders at nanoscale by drying, calcination and other heat treatments, and grows nucleation on the surface of the silver powders at nanoscale at corresponding positions, so as to coat the silver particles at nanoscale; wherein the nanoscale metal oxide provides a strong dispersion enhancement effect, improves the quality of electrical contacts, and reduces the arc erosion of electrical contacts; uniform composite fine particles at nanoscale of the metal oxide and silver particles greatly increase the infiltration between the silver and metal oxide, significantly prolonging the electrical endurance of the electrical contact material, with the electrical endurance being greater than 1,000,000 times.

BRIEF DESCRIPTION OF THE DRAWINGS

Embodiments of the present invention will now be described, by way of example only, with reference to the accompanying drawings in which like parts are designated by like reference numerals, in which.

DETAILED DESCRIPTION

The principles and spirit of the present invention will be described below with reference to exemplary embodiments. It is to be understood that the description of these embodiments is intended to enable those skilled in the art to better understand and practice the invention without limiting the scope of the invention in any way.

The preparation method for the silver-metal oxide electrical contact material according to the embodiments of the invention simply uses in-situ synthesis liquid phase reduction, filtration, drying and calcination to produce silver powder at micro-nanoscale which is coated with a metal oxide at nanoscale. Specifically, said preparation method includes steps of: mixing a silver-containing precursor solution with a metal oxide precursor solution; reacting a reducing agent with the mixed solution to obtain silver powder coated with a metal oxide precursor; and heat treating the silver powder in a non-reducing atmosphere to obtain the silver-metal oxide electrical contact material.

Figure 1:
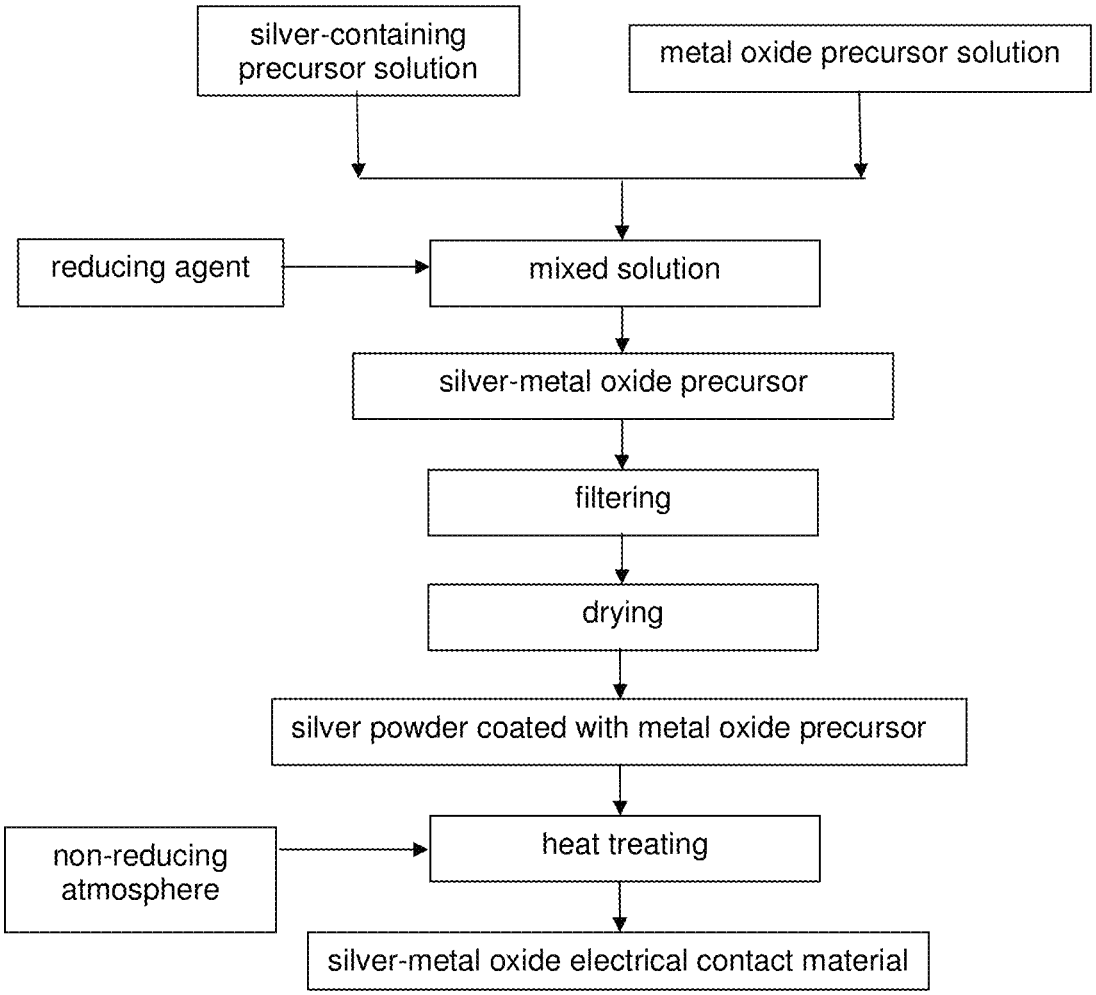
FIG. 1 is a flow chart of a preparation method for a silver-metal oxide electrical contact material according to one embodiment of the present invention.

In one embodiment of the present invention, as shown in FIG. 1, preparation conditions and process steps are:

A) Preparation of Mixed Solution

First, a silver-containing precursor solution and a metal oxide precursor solution are prepared respectively: for example, ammonia water is added dropwise into a silver nitrate solution to prepare a silver ammonia (complex) solution as the silver-containing precursor solution, in which the silver concentration is 10 to 1000 ppm; a metal hydroxide is added into acetic acid, nitric acid and the like to form a metal acetate or nitrate as the metal oxide precursor, in which the metal is one or more of Zn, Cu, In, Ni, W, Mo.

The silver-containing precursor solution and the metal oxide precursor solution are then mixed. Specifically, the metal oxide precursor solution is added into the silver-containing precursor solution. For example, a metal acetate or nitrate solution such as copper acetate, copper nitrate, etc. is added into the silver ammonia solution.

B) Reduction-Precipitation Reaction

A reducing agent such as hydrazine hydrate ($N_2H_4.H_2O$), ascorbic acid ($C_6H_3O_6$), sodium borohydride, etc. is added into a mixed solution containing silver ammonia ions and the metal oxide precursor (such as zinc acetate) to conduct a reduction-precipitation reaction, with a reaction time of 0.5 to 24 h, preferably 0.5 h. The silver ions in the silver ammonia ions are reduced to elemental silver and precipitated so as to obtain a mixture suspension containing metallic silver.

C) Filtration and Drying

The mixture suspension obtained by the reduction-precipitation reaction is filtered by a filtration method such as plate-frame pressure filtration, centrifugal or negative pressure suction filtration, and the precipitate obtained by the filtration is dried to obtain silver powder coated with a metal oxide precursor.

D) Heat Treatment

The obtained silver powder coated with the metal oxide precursor is subjected to a heat treatment in a non-reducing atmosphere, i.e., calcination, with a heat treatment temperature of 150 to 800° C. Said non-reducing atmosphere includes an inert atmosphere or an oxidizing atmosphere so as to ensure that no reduction reaction occurs. The inert atmosphere includes nitrogen and/or rare gases, such as one or more of argon, helium and neon. After being calcined, the metal oxide precursor is converted into the metal oxide, such as one or more of ZnO, CuO, $In_2O_3$, $Ni_2O$, $WO_3$, and $MoO_3$, so as to obtain the silver-metal oxide electrical contact material (powder).

The method of the present invention has the advantages of simple production process, low cost and suitable for industrial production. The prepared silver-metal oxide powder is at nanoscale, has a strong dispersion strengthening effect and improves the performance and life of the electrical contact material.

The present invention will be further explained below with reference to specific embodiments. It is to be understood that these embodiments are merely illustrative of the invention and are not intended to limit the scope of the invention.

Embodiment 1

(1) A silver ammonia complex solution and a zinc acetate solution are respectively prepared, the silver concentration being 10 to 1000 ppm;

(2) The zinc acetate solution is added into the silver ammonia complex solution, the ratio of the two being 1:1, and they are mixed evenly;

(3) In the mixed solution obtained at the step (2), a certain amount of hydrazine hydrate is added and mixed evenly, the ratio of silver ions to hydrazine hydrate in the mixed solution being 4:3, after reaction for 0.5 h, filtration and drying are performed to obtain silver powder coated with a zinc oxide precursor;

(4) The silver powder obtained in step (3) is calcined at 300° C. for 12 h under a pure nitrogen atmosphere to prepare an Ag—ZnO electrical contact material.

The sample prepared in Embodiment 1 is subjected to test analyses, and the specific results are as follows:

First, ICP-MS mass spectrometry is conducted. The ICP-MS mass spectrometry shows that the content of element Zn in the sample is about 30.13%, which indicates that the nano-mixed powder also includes a large amount of Zn element in addition to the silver element, and Zn compounds occupy a large proportion. Theoretically the sample belongs to a mixture of the silver powder and zinc oxide powder, and it can be speculated that silver particles and zinc oxide are relatively prevalent in the powder, and it would result in a better coating effect.

Figure 2:
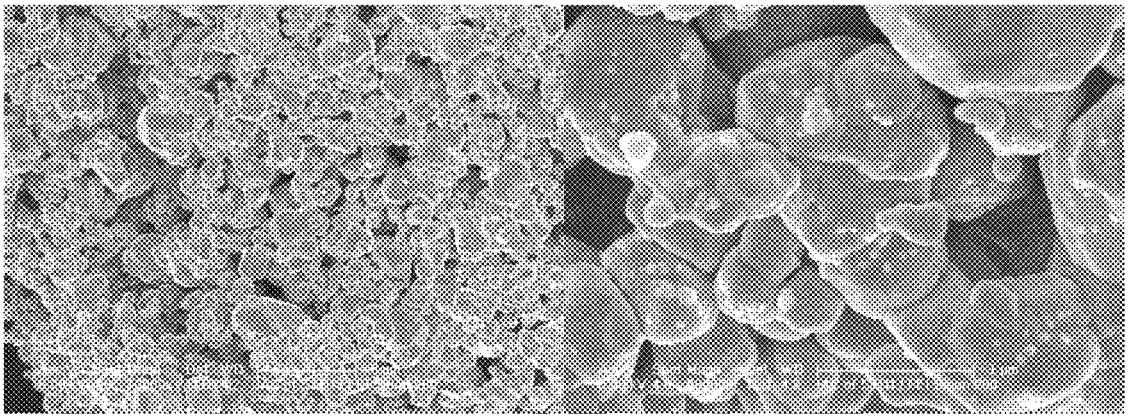
FIG. 2 is an SEM photograph of a silver-zinc oxide sample prepared according to one embodiment of the preparation method of the present invention.
Figure 3:
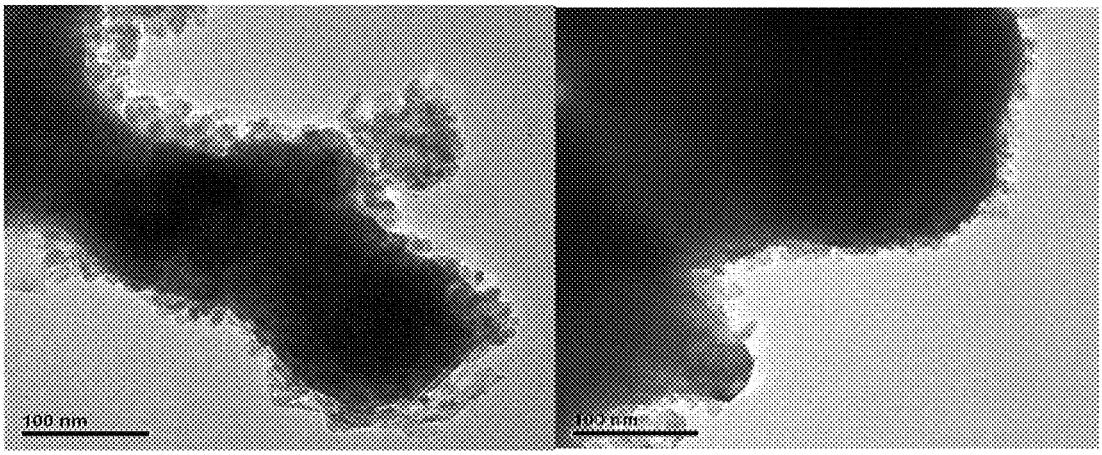
FIG. 3 is a TEM photograph of the silver-zinc oxide sample of FIG. 1.

The microstructures and coating effects of the powder are characterized by TEM and SEM electron microscopic photographs. FIG. 2 is an SEM photograph of the silver-zinc oxide sample prepared in Embodiment 1, showing a topography photograph at a scale of 5 μm and 1 μm. It can be seen that the distribution of silver powder in the microstructure of the sample is relatively uniform, and glued by some solid matters. It can be seen from the figure that some of the silver powder particles have some solid particles grown on the surfaces, and this phenomenon can be further analyzed by TEM photograph (FIG. 3). From the TEM photograph of the sample, it is observed that the surfaces of some silver powder particles form a uniform transparent film layer, and the surfaces of some silver powder particles form a large amount of granular adsorbent, whose thickness is uneven, and the growth direction is perpendicular to the surface of silver powder. In combination with the previous analyses, it is presumed that the particulate matter is an oxide precipitated separately from the adsorption solution after the formation of the film layer, and the film layer and the particulate matter should be zinc oxide.

Embodiment 2

(1) A silver ammonia complex solution and a copper acetate solution are respectively prepared, the silver concentration being 10 to 1000 ppm;

(2) The copper acetate solution is added into the silver ammonia complex solution, the ratio of the two being 1:1, and they are mixed evenly;

(3) In the mixed solution obtained at the step (2), a certain amount of hydrazine hydrate is added and mixed evenly, the ratio of silver ions to hydrazine hydrate in the mixed solution being 4:3, after reaction for 0.5 h, filtration and drying are performed to obtain silver powder coated with a copper oxide precursor;

(4) The silver powder obtained in step (3) is calcined at 300° C. for 12 h under a pure nitrogen atmosphere to prepare an Ag—CuO electrical contact material.

Embodiment 3

(1) A silver ammonia complex solution and a copper acetate solution are respectively prepared, the silver concentration being 10 to 1000 ppm;

(2) The copper acetate solution is added into the silver ammonia complex solution, the ratio of the two being 1:1, and they are mixed evenly;

(3) In the mixed solution obtained at the step (2), a certain amount of ascorbic acid is added and mixed evenly, the ratio of silver ions to ascorbic acid in the mixed solution being 2:1, after reaction for 0.5 h, filtration and drying are performed to obtain silver powder coated with a copper oxide precursor;

(4) The silver powder obtained in step (3) is calcined at 150° C. for 12 h under an air atmosphere to prepare an Ag—CuO electrical contact material.

The sample prepared in Embodiment 3 is subjected to test analyses, and the specific results are as follows:

ICP-MS mass spectrometry is conducted. The ICP-MS mass spectrometry shows that the content of element Cu in the sample is about 13.06%, which indicates that the sample contains a relatively large amount of Cu element. Theoretically the sample belongs to a powder mixture of the silver powder and copper oxide, and it can be speculated that silver particles and copper oxide are relatively prevalent in the powder.

Figure 4:
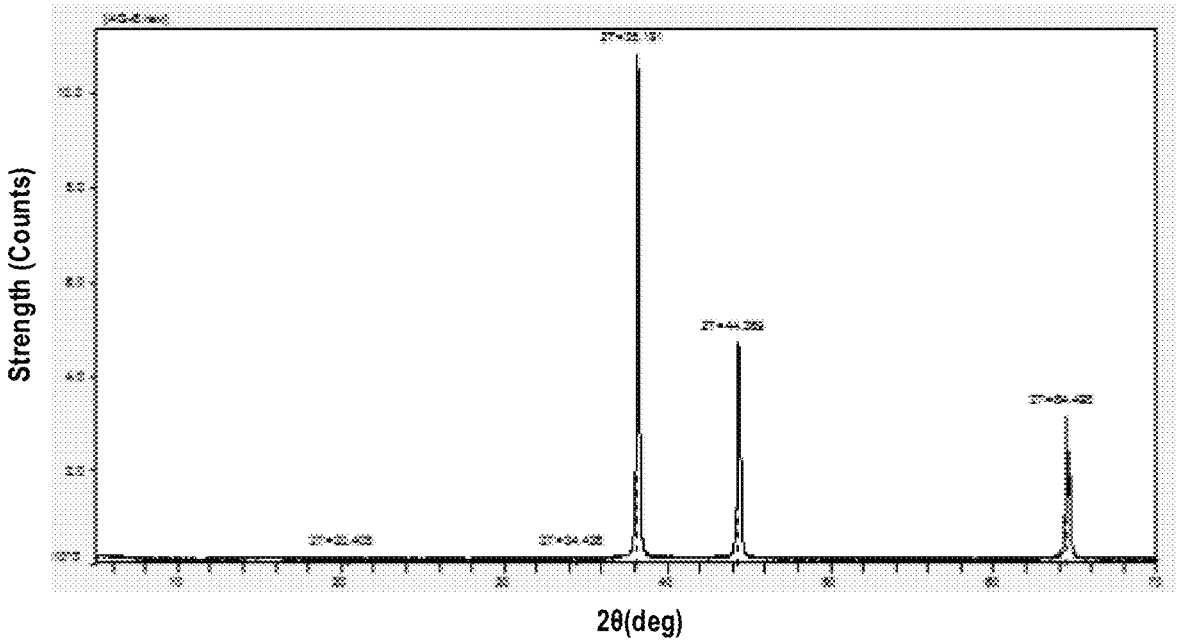
FIG. 4 is an X-ray diffraction pattern of a silver-copper oxide sample prepared according to another embodiment of the preparation method of the present invention.

The powder sample is tested by XRD phase analysis by means of an X-ray diffraction pattern of a silver-copper oxide sample, as shown in FIG. 4. By comparing the corresponding XRD software database analysis, it is known that the sample contains the corresponding diffraction angle of the corresponding crystal surface of copper oxide, it can be proved that the nano-mixed powder contains copper oxide. This analysis is also more consistent with ICP-MS mass spectrometry results.

Figure 5:
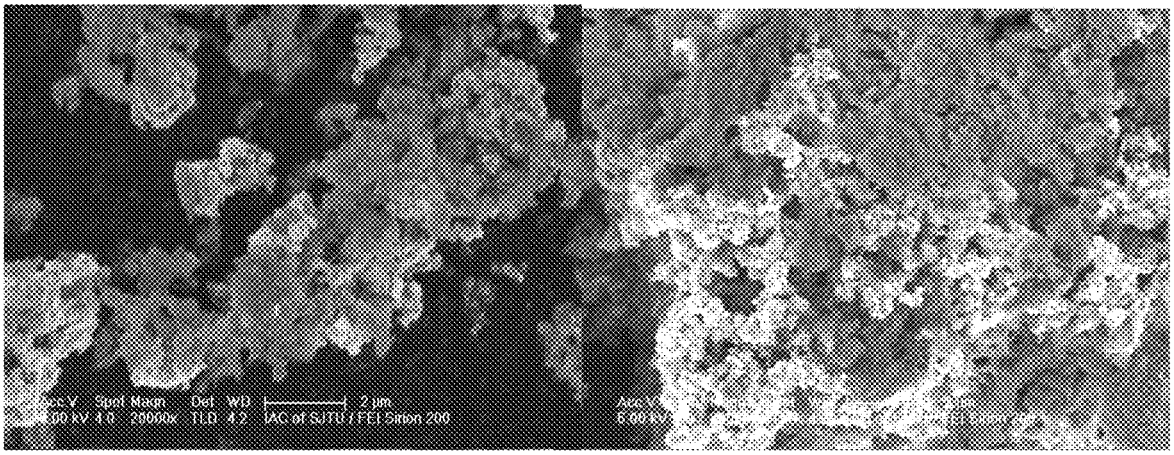
FIG. 5 is an SEM photograph of the silver-copper oxide sample of FIG. 4.
Figure 6:
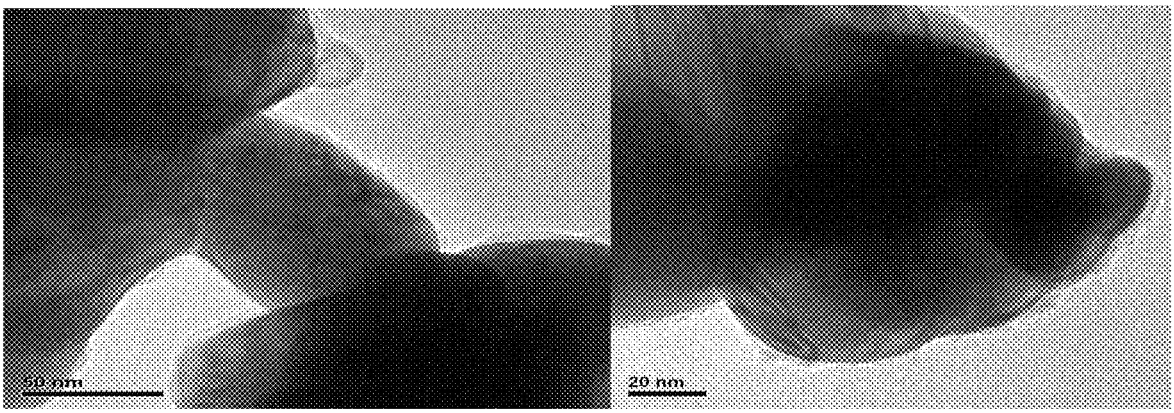
FIG. 6 is a TEM photograph of the silver-copper oxide sample of FIG. 4.

The microstructures and coating effects of the powder are characterized by TEM and SEM electron microscopic photographs. FIG. 5 is an SEM photograph of the silver-copper oxide sample prepared in Embodiment 3, showing a topography photograph of the sample at a scale of 2 μm. It can be seen that in the microstructure of the sample, the silver powder mostly has aggregation and adhesion phenomenon, and it is clear that the silver particles are coated with a thick layer of solid matters. Through the previous analysis, it can be judged that these coating layers should be solid copper oxide, but the coating effect needs to be analyzed and summarized at a greater magnification. TEM photograph (FIG. 6) can be used for further analysis. From the TEM photograph of the sample, it can be observed and analyzed that a silver powder surface film layer of the sample is well formed and is relatively continuous, but the thickness of some parts of the film is not uniform enough. In addition, there are solid matters adsorbed in the form of particles on a part of the silver particles. In connection with the previous analysis, it is judged that the coating film layer matter should be copper oxide, and copper oxide has a relatively good coating effect for silver powder.

Embodiment 4

(1) A silver ammonia complex solution and a zinc acetate solution are respectively prepared, the silver concentration being 10 to 1000 ppm;

(2) The zinc acetate solution is added into the silver ammonia complex solution, the ratio of the two being 1:1, and they are mixed evenly;

(3) In the mixed solution obtained at the step (2), a certain amount of hydrazine hydrate is added and mixed evenly, the ratio of silver ions to hydrazine hydrate in the mixed solution being 4:3, after reaction for 0.5 h, filtration and drying are performed to obtain silver powder coated with a zinc oxide precursor;

(4) The silver powder obtained in step (3) is calcined at 600° C. for 2 h under a pure argon atmosphere to prepare an Ag—ZnO electrical contact material.

Embodiment 5

(1) A silver ammonia complex solution and a nickel acetate solution are respectively prepared, the silver concentration being 10 to 1000 ppm;

(2) The nickel acetate solution is added into the silver ammonia complex solution, the ratio of the two being 1:1, and they are mixed evenly;

(3) In the mixed solution obtained at the step (2), a certain amount of sodium borohydride is added and mixed evenly, the ratio of silver ions to sodium borohydride in the mixed solution being 1:1, after reaction for 0.5 h, filtration and drying are performed to obtain silver powder coated with a nickel oxide precursor;

(4) The silver powder obtained in step (3) is calcined at 800° C. for 12 h under a pure nitrogen atmosphere to prepare an Ag—$Ni_2O$ electrical contact material.

Embodiment 6

(1) A silver ammonia complex solution and a nickel acetate solution are respectively prepared, the silver concentration being 10 to 1000 ppm;

(2) The nickel acetate solution is added into the silver ammonia complex solution, the ratio of the two being 1:1, and they are mixed evenly;

(3) In the mixed solution obtained at the step (2), a certain amount of sodium borohydride is added and mixed evenly, the ratio of silver ions to sodium borohydride in the mixed solution being 1:1, after reaction for 24 h, filtration and drying are performed to obtain silver powder coated with a nickel oxide precursor;

(4) The silver powder obtained in step (3) is calcined at 800° C. for 1 h under a pure nitrogen atmosphere to prepare an Ag—$Ni_2O$ electrical contact material.

Figure 7:
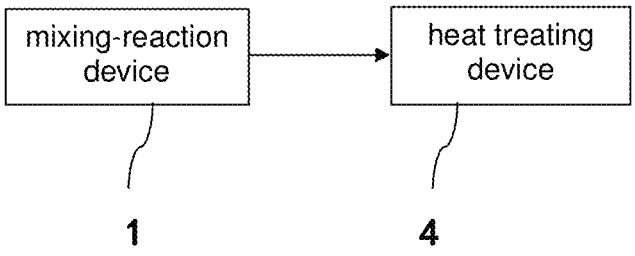
FIG. 7 is a schematic view of a preparation device for a silver-metal oxide electrical contact material according to one embodiment of the present invention.

FIG. 7 shows a preparation device for a silver-metal oxide electrical contact material according to one embodiment of the present invention, comprising:

a mixing-reaction device 1 for mixing a silver-containing precursor solution and a metal oxide precursor solution, and reacting the mixed solution with a reducing agent to obtain silver powder coated with a metal oxide precursor;

a heat treating device 4 for heat-treating the obtained silver powder in a non-reducing atmosphere to prepare a silver-metal oxide electrical contact material.

Figure 8:
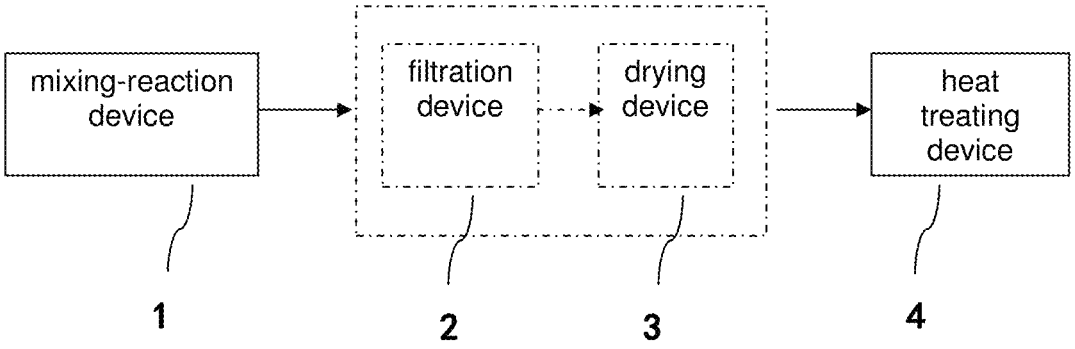
FIG. 8 is a schematic view of a preparation device for a silver-metal oxide electrical contact material according to another embodiment of the present invention.

In one embodiment, as shown in FIG. 8, said preparation device further includes:

a filtration device 2 for filtering the suspension obtained by the reaction in the mixing-reaction device 1; and a drying device 3 for drying the precipitate obtained in the filtration device 2.

Figure 9:
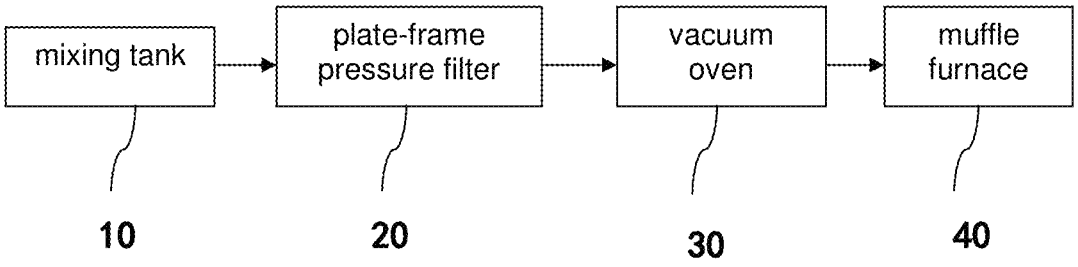
FIG. 9 is a schematic view of a preparation device for a silver-metal oxide electrical contact material according to an exemplary embodiment of the present invention.

In one embodiment of the present invention, as shown in FIG. 9, in the above preparation device, the mixing-reaction device may be a mixing tank 10. For example, the silver ammonia solution is mixed with copper acetate in the tank, and then mixed with hydrazine hydrate to carry out the reduction and precipitation reaction to produce a mixture suspension containing elemental silver. The mixture suspension is filtered through a filtration device such as a plate-frame pressure filter 20 (or a negative pressure suction filter, a centrifugal filter). The filtered silver-metal oxide precursor-coated precipitate is dried in a drying device such as a vacuum oven 30, thereby obtaining silver powder coated with a metal oxide precursor (e.g., copper acetate). Finally, the silver powder is heat treated (calcined) in a heat treating device such as a muffle furnace 40 (or tunnel kiln, mesh belt furnace, rotary kiln, etc.). The silver-metal oxide (e.g., copper oxide) electrical contact material is eventually made.

In addition, a silver-metal oxide electrical contact material can also be prepared by the preparation method for the silver-metal oxide electrical contact material according to the embodiment of the present invention. Further, an electrical contact is produced using the silver-metal oxide electrical contact material of the embodiment of the present invention.

The description of the invention has been presented for purposes of illustration and description, but is not intended to be exhaustive or limited to the form of the disclosed invention. Numerous modifications and variations will occur to those skilled in the art.

We claim:

1. A preparation method for a silver-metal oxide electrical contact material, comprising:

(1) mixing a silver-containing precursor solution with a metal oxide precursor solution;

(2) reacting a reducing agent with the mixed solution to obtain silver powder coated with a metal oxide precursor; and (3) heat treating the silver powder in a non-reducing atmosphere to obtain the silver-metal oxide electrical contact material, wherein the metal oxide precursor solution is a metal acetate, and wherein a metal of the metal acetate is one or more of Zn, Cu, In, Ni, W, and Mo.

2. The method according to claim 1, wherein the step (2) further includes:

reacting the reducing agent with the mixed solution, filtering a suspension obtained by the reacting, and drying a precipitate obtained by the filtering, to obtain the silver powder coated with the metal oxide precursor.

3. The method according to claim 1, wherein the silver-containing precursor solution is a silver ammonia solution with a silver concentration of 10 to 1000 ppm.

4. The method according to claim 1, wherein the metal oxide is one or more of ZnO, CuO, $In_2O_3$, $Ni_2O$, $WO_3$, and $MoO_3$.

5. The method according to claim 1, wherein the reducing agent is one or more of hydrazine hydrate, ascorbic acid and sodium borohydride.

6. The method according to claim 1, wherein the non-reducing atmosphere is an inert atmosphere or an oxidizing atmosphere.

7. The method according to claim 6, wherein the inert atmosphere is one or more of nitrogen, argon, helium, and neon.

8. The method according to claim 1, wherein the heat treating is calcining at 150 to 800° C. for 1 to 12 hours.

9. The method according to claim 1, wherein a mass percentage of the silver in the silver-metal oxide electrical contact material is 65 to 99%.

10. The method according to claim 1, wherein at least one of silver particles and metal oxide particles in the silver-metal oxide electrical contact material are at nanoscale.

* * * * *